United States Patent [19]

Yagi et al.

[11] 4,079,157

[45] Mar. 14, 1978

[54] METHOD OF FABRICATION OF DISTORTION-RESISTANT MATERIAL

[75] Inventors: Toshio Yagi, Higashi Hiroshima; Junichi Yamamoto, Hiroshima; Kiyokazu Inmaru, Higashi Hiroshima, all of Japan

[73] Assignee: Toyo Kogyo Co., Ltd., Japan

[21] Appl. No.: 743,405

[22] Filed: Nov. 19, 1976

[30] Foreign Application Priority Data

Nov. 19, 1975 Japan ..... 50-139462

[51] Int. Cl.[2] ..... C23C 1/08

[52] U.S. Cl. ..... 427/380; 427/383 D; 427/431; 428/653

[58] Field of Search ..... 148/6.3, 6.35, 136, 148/137; 427/383 D, 431, 380; 29/196.2, 197, 191, 191.6; 428/653

[56] References Cited

U.S. PATENT DOCUMENTS

| | | | |
|---|---|---|---|
| 2,406,245 | 8/1946 | Oganowski et al. | 29/196.2 |
| 3,378,359 | 4/1968 | Walston | 29/197 X |
| 3,465,423 | 9/1969 | Kiesler et al. | 164/75 X |
| 3,907,611 | 9/1975 | Sasame et al. | 148/6.3 |
| 3,959,035 | 5/1976 | Sheehan | 427/431 |

*Primary Examiner*—Ralph S. Kendall

*Attorney, Agent, or Firm*—Wenderoth, Lind & Ponack

[57] ABSTRACT

Method of fabrication of material suited for use in a thermal reactor according to which austenitic stainless steel is dipped in a bath of molten aluminium in addition of silicon and then receives heat treatment in specific temperature ranges, whereby preferential diffusion of silicon in the steel material is effected. The diffused silicon prevents diffusion of aluminium and ensures that thickness of plating layers remains at a value such that distortion of a plated element does not occur even after prolonged service.

3 Claims, 7 Drawing Figures

METHOD OF FABRICATION OF DISTORTION-RESISTANT MATERIAL

The present invention relates to material which has improved resistance to deformation and is particularly suited to use in construction of a thermal reactor.

It is known to provide, in association with the internal combustion engine of an automobile for example, means for combustion of unburnt constituents of exhaust gas of the engine, such a burning means being commonly referred to as a thermal reactor. To ensure achievement and maintenance of requisitely high temperature in the interior of a thermal reactor it is known to provide a thermal reactor having a multiple wall construction, in which, as disclosed in U.S. Pat. No. 3,921,395, for example, a pair of axially aligned inner shells are contained in and separated a slight distance from an outer shell, whereby in the most interior portion of the reactor defined by the inner shells there is defined a reaction chamber for oxidation of unoxidized exhaust gas constituents, and between the inner shells and the outer shell there is defined a passage via which purified exhaust gas may be subsequently led to an outlet defined at one end of the outer shell. The inner surface of the outer shell may be optionally lined with insulating material. As well as permitting production of requisitely high temperature in the interior of the thermal reactor, such a construction also has the advantage that mounting of the thermal reactor is facilitated, since the main portion of the thermal reactor which is connected to fixed portions of the engine is the outer shell, which is subject to comparatively lower temperatures during operation of the engine, and therefore expands and contracts less than the inner shells.

While such a thermal reactor can produce good results with respect to purification of engine exhaust gas, in practice there are problems associated with materials of construction of the reactor, particularly the inner shell portions thereof, which must have good resistance to corrosion, good strength at high temperature and, since economic considerations cannot be ignored, must maintain these qualities during long periods of service of the thermal reactor.

Elements of a thermal reactor are subject to highly corrosive conditions since they are brought into direct contact with hot exhaust gas, and for this reason a preferred material for construction of principal elements of thermal reactors in the earlier stages of development of thermal reactors was ferritic stainless steel, which has good resistance to scaling and corrosion. However, since ferritic stainless steels have comparatively low strength at elevated temperatures, and since a thermal reactor in a motor vehicle is subject to considerable vibratory force as well as high temperature, use has also been made of austenitic stainless steel, which has the advantage of excellent high-temperature strength. Although these steels also have better high-temperature resistance to scaling than other stainless steels, they are subject to loss of corrosion resistance at high temperatures, and there has been accordingly a great deal of research conducted in order to improve maintenance of the corrosion resistance of austenitic stainless steels while retaining the high-strength qualities thereof. As a result of such research there has been made available, by one of the present applications and another, an improved thermal reactor construction element which, as disclosed in U.S. Pat. No. 3,907,611, is produced by dipping a thermal reactor element made of austenitic stainless steel into molten aluminum or molten aluminium containing a small amount of chromium, thereby producing a coated element which then receives suitable primary and secondary treatment to give an element having good corrosion resistance and high strength.

However, it has been found that while a thermal reactor element constructed of such material presents definite advantages, long service of the thermal reactor involving repeated heating of elements, particularly the inner shell portions thereof, to a high temperature and subsequent cooling of these elements leads to deformation of the inner shell elements and consequent narrowing of certain points of the exhaust gas passage defined between the inner shell and the outer shell to such an extent that efficient removal of purified exhaust gas from the reactor is no longer possible.

The present inventors undertook research to determine the cause of this deformation, findings being as follows. When aluminium is employed as the coating material, the bath of aluminium into which the shell of austenitic stainless steel is dipped must be maintained at a temperature in the region of 700° C, in order to maintain the aluminium in a molten state, and this temperature is high enough to promote formation of an iron-aluminium, Fe-Al, alloy. Dipping an austenitic stainless steel element into molten aluminium, followed by primary and secondary heat treatments for the plated austenitic stainless steel element results in a three-layer structure consisting of base material, which is essentially the unchanged austenitic stainless steel of the element prior to dipping, an outermost layer, referred to below as the Fe-Al alloy layer, which consists mainly of an iron-aluminium alloy, and an intermediate layer, referred to below as the Al diffusion layer, which lies between the Fe-Al alloy layer and the base material, and in which there has occurred substitutional diffusion of aluminium in the base material. X-ray analysis of aluminium-plated sheets of austenitic stainless steel shows that, going inwards from either outermost surface portion thereof, the Fe-Al layer has quite a high proportion of aluminium, and that there is a marked drop of aluminium content at the boundary of the Fe-Al layer and the Al diffusion layer, after which aluminium content falls slowly to zero, i.e., until no more aluminium is detectable, at the boundary of the Al diffusion layer and the base material. Both the Fe-Al alloy layer and the Al diffusion layer differ from the base material in that whereas the base material retains an austenitic structure, a ferritic structure is produced in the Fe-Al alloy layer and Al diffusion layer. The Fe-Al alloy layer and Al diffusion layer may thus be regarded as together constituting a ferrite layer. Repeated exposure or prolonged use of a thermal reactor element constituted by an aluminium-plated sheet of austenitic stainless steel promotes further diffusion of aluminium in the base material, and so results in gradual increase in thickness of the ferrite layer. Repeated heating or exposure of such a thermal reactor element results in deformation thereof for the following reasons. In the temperature range 0°–1,000° C the average value of coefficient of thermal expansion of material having an austenitic structure is approximately $20 \times 10^{-6}/°$ C, which is greater than the average value of the coefficient of thermal expansion of material having a ferritic structure in the same temperature range, which is approximately $16 \times 10^{-6}/°$ C. Therefore, heating and cooling of the thermal reactor elements results in different amounts of expansion of the ferrite layer, constituted by the Fe-Al alloy layer and Al diffusion layer, and of the base material constituted by austenitic stainless steel. Since the base material of the thermal reactor element is plated on both sides thereof, the result is that as temperature of the element increases the base material expands more than the ferrite layers on opposite sides thereof and causes application of stress on the ferrite layers to and beyond the point at which the elastic limit of the ferrite layers is reached, and there is consequently plastic deformation of the ferrite layers. When generally constant high temperature conditions are achieved in the thermal reactor, as when an automobile is running at a generally constant speed, internal stress is relieved in the ferrite layers, which may be considered as having a stable structure in these conditions. When, however, the thermal reactor element is cooled, the now plastically deformed ferrite layers prevent complete return of the base material to its original dimensions, and the reactor element is therefore deformed slightly and includes elongated portions. Continued repetition of heating and cooling cycles finally results in distortion of the reactor element to an extent that efficient removal of exhaust gas from the thermal reactor becomes impossible because of narrowing of certain portions of the passage defined between the inner and outer shells of the thermal reactor, as noted above. This narrowing of the purified exhaust gas passage is of course due to a certain extent to distortion of the outer shell of the thermal reactor. However, compared to the inner shell the outer shell is subjected to much smaller variation in temperature and is therefore much less liable to distortion, even after prolonged service of the thermal reactor, and for practical purposes the narrowing of the exhaust gas passage may be considered to be almost entirely due to distortion of the inner shell elements of the reactor.

Distortion of thermal reactor elements occurs in the same manner when the plating bath material consists of aluminium with additions of chrome.

Needless to say, if sheet material constituting the shell element of a thermal reactor is plated with an extremely thin protective coat of aluminium, there is effectively no restraining force which prevents return of the base material to original dimensions upon conclusion of a heating and cooling cycle. However, in this case efficiency of protection of the base material is greatly reduced. Subsequent research undertaken by the inventors was therefore directed to determining what the relative values of thickness of base material and ferrite plating layers should be in order to achieve efficient protection against corrosion but at the same time avoid distortion of inner shell elements even after prolonged service. The conclusions of the research were that, designating the sum of the thickness of one Fe-Al alloy layer and the thickness of the Al diffusion layer adjacent thereto as $\alpha$, that is, $\alpha$ is the thickness of the ferrite layer plated on one side of the base metal, and designating the thickness of the austenitic stainless steel sheet constituting the base material of a thermal reactor element as $\gamma$, repeated heating and cooling cycles result in steady expansion and increase in size of the reactor element when $0.5<2\alpha/\gamma<1$, but that there is very little expansion and no contraction of the element when $0.5>2\alpha/\gamma$. The main problem here is that of restraining thickness of the Al diffusion layer, this problem being further complicated by the fact that repeated heating and cooling of a thermal reactor element during use of the thermal reactor can result in growth of the Al diffusion layer, as noted earlier.

During tests conducted by the inventors, their attention was drawn to the fact that substitutional diffusion of silicon in steel can occur in the same manner as substitution of aluminum does, and also that the automic diameter of silicon at 2.34 A is close to but smaller than that of aluminium, which is 2.8 A. It was therefore hypothesized that preliminary diffusion of silicon in austenitic stainless steel could produce a substitutional solid solution of silicon in the austenitic stainless steel sufficiently close in structure to a substitutional solid solution of aluminium in austenitic stainless steel to effectively inhibit subsequent formation of an Al diffusion layer in the steel.

It will be noted in this respect that although it was previously known to add a few percent by weight of silicon to a molten aluminium dipping bath in order to reduce thickness of a subsequently formed Fe-Al alloy layer on ferritic stainless steel dipped in the aluminium bath, the effects exhibited by silicon when the dipped material is an austenitic stainless steel had not been established.

Subsequent tests showed that initial formation of a silicon diffusion layer in base material of austenitic stainless steel, or addition of silicon to an aluminium dipping bath into which the base material is dipped, followed by suitable post-dipping heat treatment, described below, does in fact result in inhibition of formation of the Al diffusion layer in the base material, whereby it is made possible to maintain the thickness of the ferrite layers on a thermal reactor element within requisite limits. Thus, problems of differential expansion and contraction of different layers of sheet material constituting an element of a thermal reactor are largely overcome, and the fabrication method of the invention provides distortion-resistant material suited for use as thermal reactor material which has all the advantages of high strength and corrosion resistance that conventional materials have, and further provides the advantage that deformation of thermal reactor elements after repeated heating and cooling cycles is avoided, so ensuring longer service of thermal reactors. According to the present invention, the fabrication method of distortion-resistant material comprises in combination, steps of effecting a plating process which consists of dipping a sheet of austenitic stainless steel in a bath which consists of aluminium and an amount of silicon in the range of from 5 to 11% by weight and which bath is heated to a temperature in the range of from 700° to 750° C, maintaining said sheet immersed in said bath for a period of time in the range of from 30 to 120 seconds, and then withdrawing said sheet from said bath, the original thickness of said sheet of austenitic steel being such that the quotient of the total value of the combined thickness of iron-aluminium alloy layers and aluminium diffusion layers formed on said sheet divided by the value of the thickness of that portion of said sheet whose composition remains unchanged subsequent to said plating and heat treatment processes is less than 0.5; effecting a primary heat treatment process which consists of subsequently heating said sheet to a temperature in the range of from 750° to 850° C and maintaining said sheet at said temperature for at least 60 minutes; and effecting a secodary heat treatment process which consists of subsequently heating said sheet to a temperature in the range of from 900° to 1,000° C maintaining said sheet at said temperature for at least 60 minutes.

The description of the invention continues in reference to the attached drawings, in which FIG. 1 is a graph showing changes with temperature of coefficients of diffusion of aluminium and silicon in iron;

Figure 4:
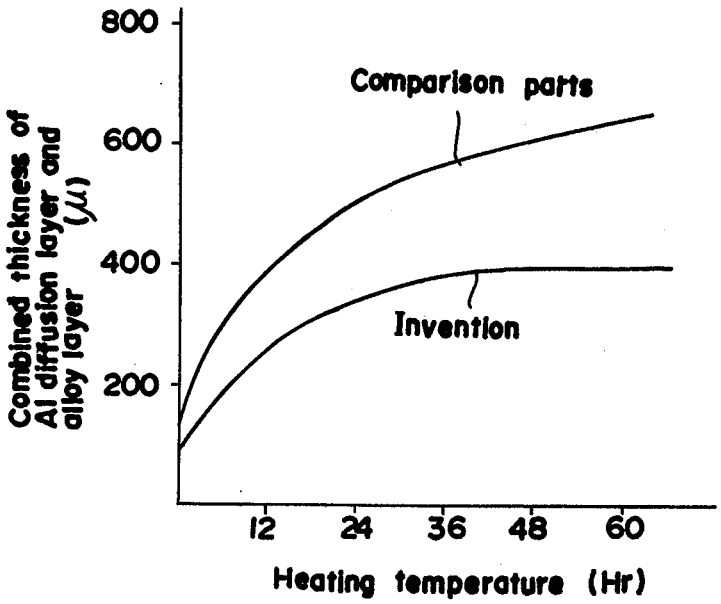
FIG. 4 is a graph showing how changes in heating temperature effect the combined thickness of the Al diffusion layer and the Fe-Al alloy layer formed on the samples of the invention and the comparison parts of aluminium melting plate.
Figure 5A:
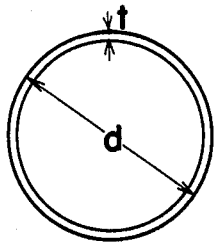
Figure 5B:
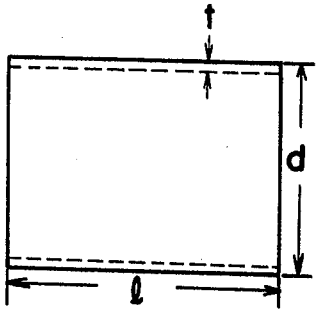
Figure 6:
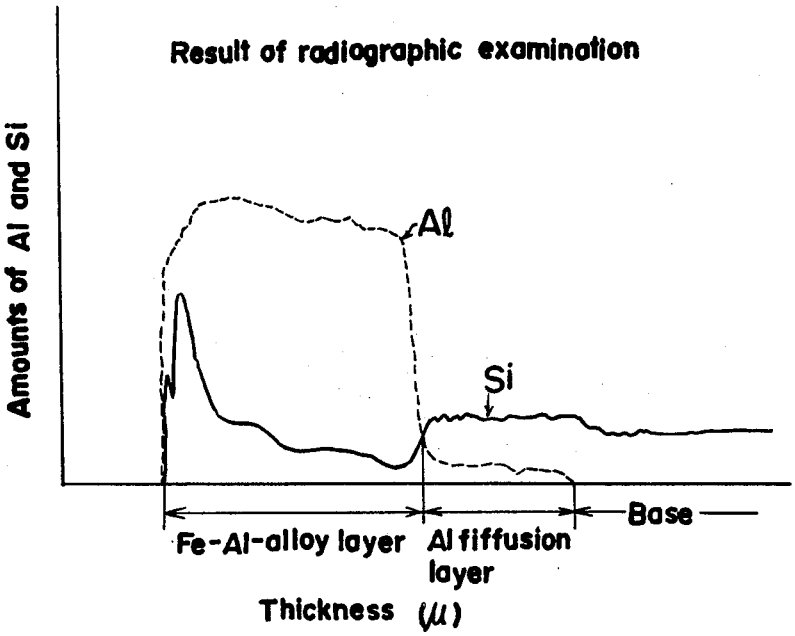

FIGS. 5(*a*) and 5(*b*) are respectively to plane and side elevational views of the samples subjected to a test of FIG. 4; and FIG. 6 is a graph showing, in magnification of 200 times, the effect of electronic beam scanning obtained by means of a radiographic micro-analyzer in connection with Al and Si of the coated layer of material for thermal reactors of engines of the invention.

Before proceeding with the description it is to be noted that percentage values indicating proportions of different constituents of various materials described below refer to percentage by weight.

Figure 1:
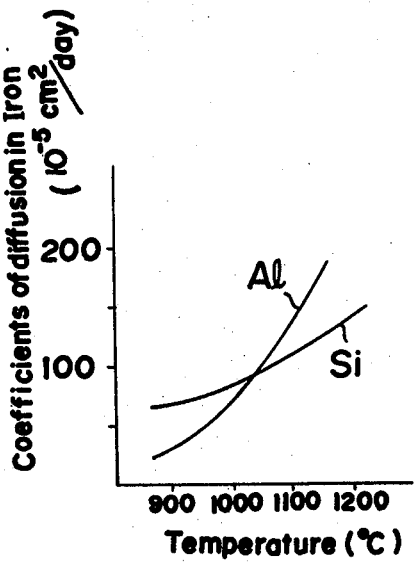

In work on establishment of the method of the invention, first it was noted that for diffusion in iron the diffusion coefficient of silicon is higher than that of aluminium in the low temperature range, defined here as lower than 1,000° C, as shown in the graph of FIG. 1. It was therefore hypothesized that by conducting at least the first step of a plating process in this low temperature range preferential diffusion of silicon in base material could be achieved, even if silicon and aluminium are simultaneously available for diffusion, as is the case when silicon is added to a plating bath of molten aluminium.

Accordingly, there were prepared molten baths of plating material having a composition of 5–11% silicon and remainder aluminium, the baths being heated to a temperature in the range 700°–750° C. In each bath there was dipped a sheet of austenitic stainless steel, the sheet being held immersed in the bath for 30–120 seconds, in order to effect plating thereof, and then being withdrawn, after which heat was applied to maintain the plated sheet at a temperature in the range 750°–850° C for at least 60 minutes and then in the range 900°–1,000° C for a further period of at least 60 minutes. It was found that post-dipping primary heat treatment or secondary heat treatment may be continued for longer than the above-noted periods, but that a heating period of longer than 3 hours in either heat treatment process produces no significant effect in the plated material. Hence, in terms of fabrication on an industrial scale, there is no point in extending the duration of each of the primary and secondary heat treatment processes beyond 3 hours.

Figure 2:
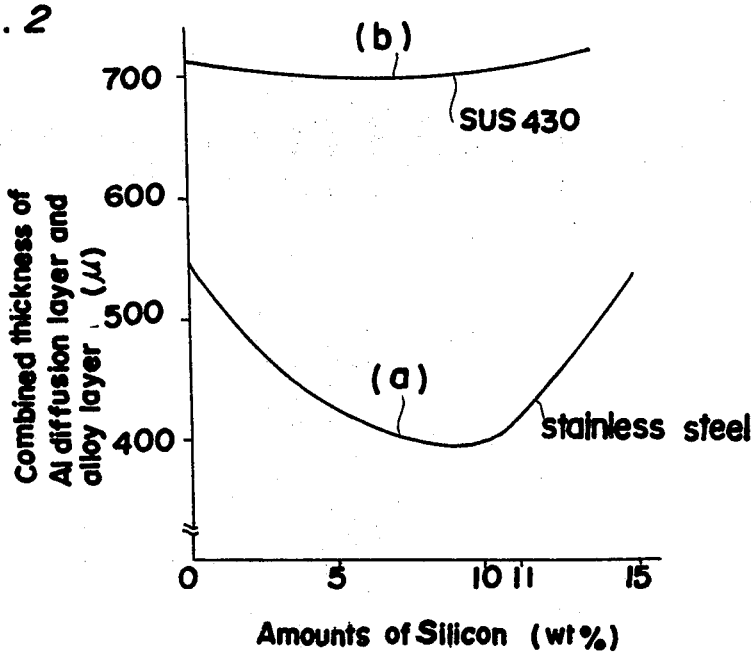
FIG. 2 is a graph showing the effect which addition of different amounts of silicon in an aluminium dipping bath has on the combined thickness of the Al diffusion layer and the Fe-Al alloy layer formed on austenitic stainless steel and ferritic stainless steel.

The effect of altering the composition and temperature of the plating bath is as follows. There is preferential diffusion of silicon in the austenitic stainless steel base material, and corresponding inhibition of diffusion of aluminium and reduction of the combined thickness of the Fe-Al alloy layer and Al diffusion layer, for even trace additions of silicon to the dipping bath, but the silicon addition needs to be of the order of 5% if satisfactory inhibition of diffusion of aluminium is to be achieved. On the other hand, addition of silicon beyond a maximum of approximately 11% results in renewed increase in diffusion of aluminium. This may be seen from the graph of FIG. 2, in which curve (*a*) shows the effect of silicon addition on values of combined thickness of the Fe-Al alloy layer and Al diffusion layer formed on sheets of austenitic stainless steel having a composition of 19% Cr, 13% Ni, 0.06% C, 3.5% Si, 0.26% Mn, and 0.74% Cu, the remainder being Fe. The sheets were immersed for 60 seconds in baths of molten aluminium maintained at 730° C and containing additions of different amounts of silicon, were then heated and held at a temperature of 800° C for 90 minutes, then heated further and held at 950° C for 80 minutes, and subsequently maintained at a test temperature of 1,100° C for 25 hours. For comparison, measurement was also made of the combined thickness of the Fe-Al alloy and Al diffusion layers formed on sheets of the ferritic stainless steel designated as SUS 430 according to Japanese Industrial Standards, which were plated under the same conditions as the above-described austenitic stainless steel sheets, after which they were heated to a temperature of 950° C and held thereat for a period of 60 minutes, and then subjected to a high-temperature test conducted at 1,100° C for 25 hours. Values obtained for the sheets of ferritic stainless steel are indicated by the curve (*b*) of FIG. 2, from which it is seen that in contrast to the marked effect had in sheets of austenitic stainless steel, addition of silicon to aluminium plating baths has very little effect on thickness of the Fe-Al alloy layer plus the Al diffusion layer in ferritic stainless steel. It may be supposed that these results are due to the fact that ferritic stainless steel has a structure which allows greater substitutional diffusion of alloying elements, and so permits simultaneous diffusion both of aluminium and of silicon.

Figure 3:
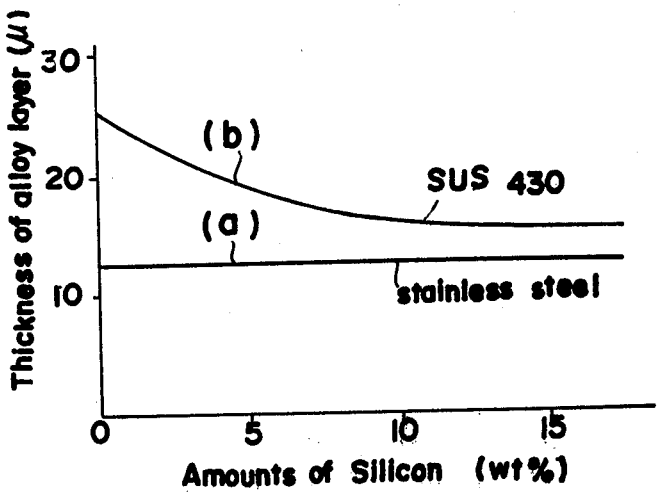
FIG. 3 is a graph showing the effect which addition of different amounts of silicon in an aluminium dipping bath has on the thickness of the Fe-Al alloy layer on dipped austenitic stainless steel and ferritic stainless steel.

The effect of different amounts of silicon and the thickness of the Fe-Al alloy layer is as follows. Addition of silicon to aluminium plating baths does affect the thickness of the Fe-Al alloy layer on plated sheets of ferritic stainless steel, as is known conventionally and as shown in FIG. 3. The graph of FIG. 3 was obtained by plotting measured values of thickness of the Fe-Al alloy layers formed on plated sheets of austenitic stainless steel having the composition noted above and on sheets of SUS 430 ferritic stainless steel which were plated by immersion thereof for 60 seconds in baths of aluminium which contained different amounts of silicon and were heated to 730° C, values for the austenitic stainless steel sheets being indicated by the curve (*a*) and values for the SUS 430 ferritic stainless steel sheets by the curve (*b*). It is seen that whereas varying the amount of added silicon results in varying thickness of the Fe-Al alloy layers on plated sheets of SUS 430 ferritic stainless steel, thickness of the Fe-Al alloy layers on sheets of austenitic stainless steel is more or less unaffected by addition of different amounts of silicon to dipping baths. In other words, by comparing FIGS. 2 and 3, one sees that for austenitic stainless steels the principal effect of addition of silicon to aluminium plating baths is to control thickness of the Al diffusion layer.

Considering now conditions of the primary heat treatment effected subsequent to the plating process, according to the invention it is necessary to maintain plated base material at a temperature which is in the range of from 750° to 850° C for at least 60 minutes. It is necessary to effect primary heat treatment in these conditions in order to avoid reaction of the aluminium constituting the plating material with the nickel which is present in comparatively high proportions in austenitic stainless steel. As is known, plating of austenitic stainless steel with aluminium can cause a reaction between nickel contained in the steel and the aluminium. This being an exothermic reaction, there is a marked rise in the temperature of the steel base material and there is produced a comparatively brittle structure which is unsuited for employment in equipment subject to vibrations such as occur in an automobile thermal reactor. By carrying out primary heat treatment in the above-noted conditions practically all the free aluminium combines with iron to form an Fe-Al alloy layer, so keeping to a minimum the amount of aluminium which is able to combine with the nickel in the steel and cause embrittlement of the plated material upon subsequent heating of the plated material to higher temperatures. If primary heat treatment is conducted for less than 60 minutes and/or at a temperature lower than 750° C, there is insufficient combination of aluminium with iron, and hence an unduly large amount of aluminium left available for subsequent reaction with the nickel in the steel. On the other hand, a primary heat treatment temperature higher than 850° C is undesirable, since such a temperature promotes reaction of the aluminium and nickel.

Considering now conditions of the secondary heat treatment effected subsequent to the primary heat treatment, the secondary heat treatment is one of the most important and distinctive aspects of the method of the invention, and is effected to achieve preferential diffusion of silicon over aluminium in the base material. To meet this object, the upper limit of temperature in secondary heat treatment is a temperature which is close to but lower than the highest temperature at which the coefficient of diffusion of silicon in austenitic stainless steel is higher than that of aluminium, that is 1,000° C (see FIG. 1). A suitable lower limit of temperature is 900° C. It is possible to achieve the objects of the invention by conducting secondary heat treatment at a lower temperature, but a temperature of 900° C permits diffusion of the silicon to proceed at a rate suited to an industrial fabrication process.

The description of the invention continues in reference to specific examples of plated material fabricated by the method thereof, and to results achieved by this material compared to results achieved with conventional material. There was prepared a plurality of sheets of plated material constituting samples of the method of the invention, base material and plating and heat treatment conditions being as follows.

(*a*) Composition of plating bath —10% Si, remainder Al (*b*) Composition of base material —19% Cr, 13% Ni, 0.06% C, 3.5% Si, 0.26% Mn, 0.74% Cu, remainder Fe (*c*) Plating bath temperature and dipping duration — 730° C × 60 seconds (*d*) Primary heat treatment — 800° C × 90 minutes (*e*) Secondary heat treatment — 950° C × 80 minutes.

For comparison, there were also prepared sheets of plated material by conventional fabrication process, using base material sheets of the same composition as employed for the Samples of the invention. Plating and heat treatment conditions for the Comparison were the same as for the Samples of the invention except that the plating bath was pure aluminium. Subsequent to preparation thereof, the Samples of the invention and the Comparison sheets were heated to 1,100° C, and then the combined thickness of the Fe-Al alloy layers and Al diffusion layer formed thereon was measured at successive intervals of time while the Samples and Comparison sheets were maintained at this temperature, measured values of thickness being plotted in FIG. 4.

From FIG. 4 it is seen that on Samples of the invention the combined thickness of the Fe-Al alloy and Al diffusion layers increases with time for an initial period of approximately 36 hours, but that continued heating of the Samples results in no increase of this thickness, which remains at 380μ. In the Comparison, however, the combined thickness of the Fe-Al alloy and Al diffusion layers produced after 36 hours is much greater, at 550μ, and moreover, although there is decreased rate of increase of thickness of these layers, continued application of heat results in steady increase in the thickness of the layers.

Thus, by employment of material fabricated according to the method of the invention, the condition $0.5 > \alpha/\gamma$ may be achieved and distortion of elements of a thermal reactor avoided if the thickness of the base material is 1.6 mm, i.e., if total thickness of a plated steel sheet material constituting a thermal reactor element is 2.3 mm or over. In contrast to this, with material fabricated by conventional methods, even supposing that combined thickness of the Fe-Al alloy and Al diffusion layers remain at the value of 600μreached after 48 hours, total thickness of plated material employed for a thermal reactor element must be at least 3.6 mm, which presents practical problems in terms of thermal reactor construction.

The description of the invention continues in reference to the result of a test for the thermal reactor formed with Samples of the invention. Samples of the invention and Comparison sheets prepared in the manner described above were formed into elements such as employed for the inner shells of a thermal reactor, each element having a thickness of 2.5 mm, a diameter of 85 mm, and a length of 100 mm, as shown in FIGS. 5(*a*) and 5(*b*). Each element was then subjected to a test which consisted of 1,000 continuously repeated cycles, each of which lasted for 30 minutes, and in each of which the element was brought from a temperature of 300° to 1,050° C in a period of 8 minutes, maintained at 1,050° C for 15 minutes, and then cooled from 1,050° C to the original temperature of 300° C in a period of 7 minutes. Upon completion of the test, measurements were made of the change in diameter and length of and of the thickness of the Fe-Al alloy and Al diffusion layers on the elements, measured values being as indicated in the following table.

| | Dimensional changes of tested parts | | |
|---|---|---|---|
| | Diameter d (mm) | Length l (mm) | Post-test alloy layer + diffusion layer thickness (μ) |
| Samples of the invention | +1 | +1 | 250 |
| Comparison sheets | +13 | +10 | 690 |

As seen from these results, the method of the invention provides material which is much less subject to distortion as a result of prolonged service in high temperature conditions than conventionally fabricated material, and the invention thus resolves what was hitherto one of the major problems concerning material for thermal reactors of engines of automobiles or similar equipment, and makes it possible to achieve both high strength and continued corrosion resistance of aluminium-plated materials.

The effect of restriction of aluminium diffusion is further shown in FIG. 6, which plots values determined by radiographic examination of austenitic stainless steel having a composition of 19% Cr, 13% Ni, 0.06% C, 3.5% Si, 0.26% Mn, and 0.74% Cu, the remainder being Fe, which was immersed for 60 seconds in an aluminium plating bath heated to 730° C and containing a 6.5% addition of silicon, and then received primary heat treatment for 90 minutes at 800° C, and secondary heat treatment for 80 minutes at 950° C. As will be appreciated from FIG. 6, the diffused element in the next layer inward of the outermost Fe-Al alloy layer is silicon, which acts as a barrier to diffusion of aluminium in the base material.

The invention has thus been described with reference to specific samples, however, it should be noted that the invention is in no way limited to the illustrated details thereof but changes and modifications may be made without departing from the scope of the appended claims.

What is claimed is:

1. A method of preparing a distortion-resistant material which comprises dipping a sheet consisting of austenitic stainless steel in a bath consisting essentially of aluminium and from 5 to 11% by weight of silicon, the temperature of said bath being in the range of from 700° to 750° C, maintaining said sheet immersed in said bath for a period of time in the range of from 30 seconds to 120 seconds, withdrawing said sheet from said bath, effecting a primary heat treatment by heating said sheet to a temperature in the range of from 750° to 850° C and maintaining said sheet at said temperature for at least 60 minutes, and effecting a secondary heat treatment by heating said sheet to a temperature in the range of from 900° to 1,000° C and maintaining said sheet at said temperature for at least 60 minutes thus forming a material comprising (1) a base having a composition which is the same as said sheet, (2) iron-aluminium alloy layers and (3) aluminium diffusion layers.

2. A method as claimed in claim 1, wherein the thickness of said sheet of austenitic stainless steel prior to dipping said sheet in said bath is such that the quotient of the total value of the combined thickness of said iron-aluminium alloy layers and said aluminium diffusion layers divided by the value of the thickness of said base is less than 0.5.

3. A method as claimed in claim 1, wherein each of said primary heat treatment and said secondary heat treatment is carried out for a period of time in the range of from 1 hour to 3 hours.

* * * * *